United States Patent [19]

Hetman et al.

[11] 4,136,419

[45] Jan. 30, 1979

[54] APPARATUS FOR CLEANING A COLUMN OF WINDOWS AND WALL SURFACES OF A BUILDING

[75] Inventors: Frank W. Hetman, Minneapolis; Kenneth D. Rakouska, Excelsior; Robert N. Baron, Champlin, all of Minn.

[73] Assignee: Alpana Aluminum Products, Inc., Minneapolis, Minn.

[21] Appl. No.: 792,972

[22] Filed: May 2, 1977

[51] Int. Cl.[2] ..... A47L 1/04

[52] U.S. Cl. ..... 15/302; 15/50 R; 15/312 R

[58] Field of Search ..... 15/302, 50 R, 98, 103, 15/312 R

[56] References Cited

U.S. PATENT DOCUMENTS

| | | | |
|---|---|---|---|
| 3,344,454 | 10/1967 | Mikalson | 15/50 C |
| 3,497,902 | 3/1970 | Hartigan | 15/302 |
| 3,895,406 | 7/1975 | Fannon, Jr. | 15/302 |
| 4,025,984 | 5/1977 | Hoener | 15/302 |

*Primary Examiner*—Christopher K. Moore
*Attorney, Agent, or Firm*—Wicks & Nemer

[57] ABSTRACT

An apparatus for cleaning windows and wall surfaces of a building which includes a cleaning head unit having squeegee blades, cleaning fluid nozzles and brushes together with apparatus for producing a vacuum pickup between the squeegee blades. The head unit is adjustably slidable on the rail of a platform and further it is mounted for lateral sliding movement on rollers engaging rails carried by the platform. The cleaning head unit includes a linkage and which allows positioning of the unit upon the window and/or wall surfaces and withdrawl of the unit from the surfaces. The cleaning head unit also has spring members for absorbing the shock of movement over irregular configurations of window and wall surfaces which also maintains the squeegees and brush in pressure engagement with the window and wall surfaces. The cleaning head unit cleans as the same is lowered and raised with the platform.

10 Claims, 7 Drawing Figures

108
104
102
126
135
80
138
W
82
84
80
76
86
88
26
138
90
102
87
81
148
126
144
106
146
152
110
142
VP
Ek.
VAC.
RESERVOIR
R
P

APPARATUS FOR CLEANING A COLUMN OF WINDOWS AND WALL SURFACES OF A BUILDING

SUMMARY

The invention relates broadly to an improvement in devices for cleaning the exterior surface of windows and panel surfaces of a building. Related window cleaning devices are found in U.S. Pat. No. 3,425,082 and U.S. Pat. No. 3,604,049.

The present invention extends and is an improvement relative to the above referred to devices and other mobile window cleaning devices and provides a window and wall panel cleaning apparatus operable by a single operator and including a head having cleaning means. The head is adjustably positioned by clamps upon the rail member of a conventional platform such as used in the manual hand cleaning of windows of a building to allow selective positioning of the cleaning head on the platform opposite columns of windows. The cleaning head is also slidable on the selective positioning means to allow the head unit to follow configurations of the building.

The platform is connected to cables supported by support booms or arms on the top of a building, and the platform is raised and lowered by winches on the platform or on the roof in connection with the cables.

The head unit is equipped with nozzles for supplying cleaning fluid to the windows together with brushes and squeegee members for cleaning. The head also includes vacuum pickup means between the squeegee blades. A source of vacuum and cleaning fluid for the head is carried by the platform, and as the platform is raised and lowered past window and wall panels the cleaning head is maintained in pressure engagement with the same for cleaning. The lowering and raising movement of the platform is thus utilized in combination with the cleaning head to progressively clean the windows and/or wall surfaces of a building.

The head unit includes means for retracting the same to an inoperative position on the platform whereby the platform may be moved relative to the building for lowering and raising and cleaning further columns of windows and/or panels. The cleaning head unit includes means for absorbing obstructions and inequalities on the windows and wall panels to be cleaned as the head is moved over the same.

The device maybe lowered past a column of windows and/or panels with the head cleaning the same, and when it reaches the desired limit of travel, it may be slidably moved on the platform and adjusted to a position opposite a further column of windows and/or panels. Then the device is raised by means of winch and cable means on the platform and as it moves it cleans the windows and/or panels. To clean to an extent laterally that is greater than the length of the platform, the platform is then moved laterally of the building by means of support booms on the top of the building thereby moving the platform laterally relative to the building.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 1 is a perspective view of a semi-automatic window washing and drying device embodying the invention with the device shown in operative position relative to the window.

Figure 2:
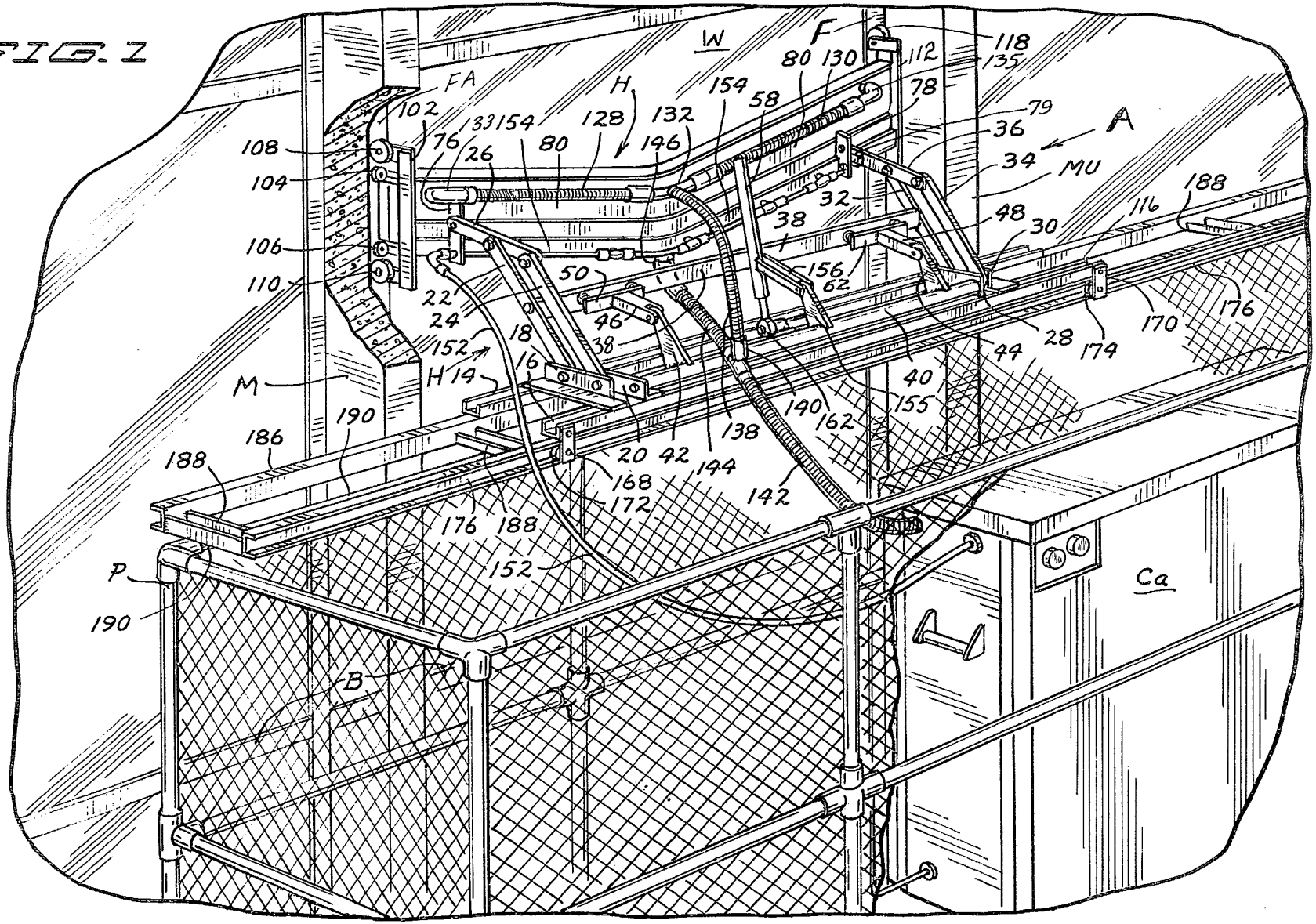
FIG. 2 is a top plan view of the washing head.
Figure 2:
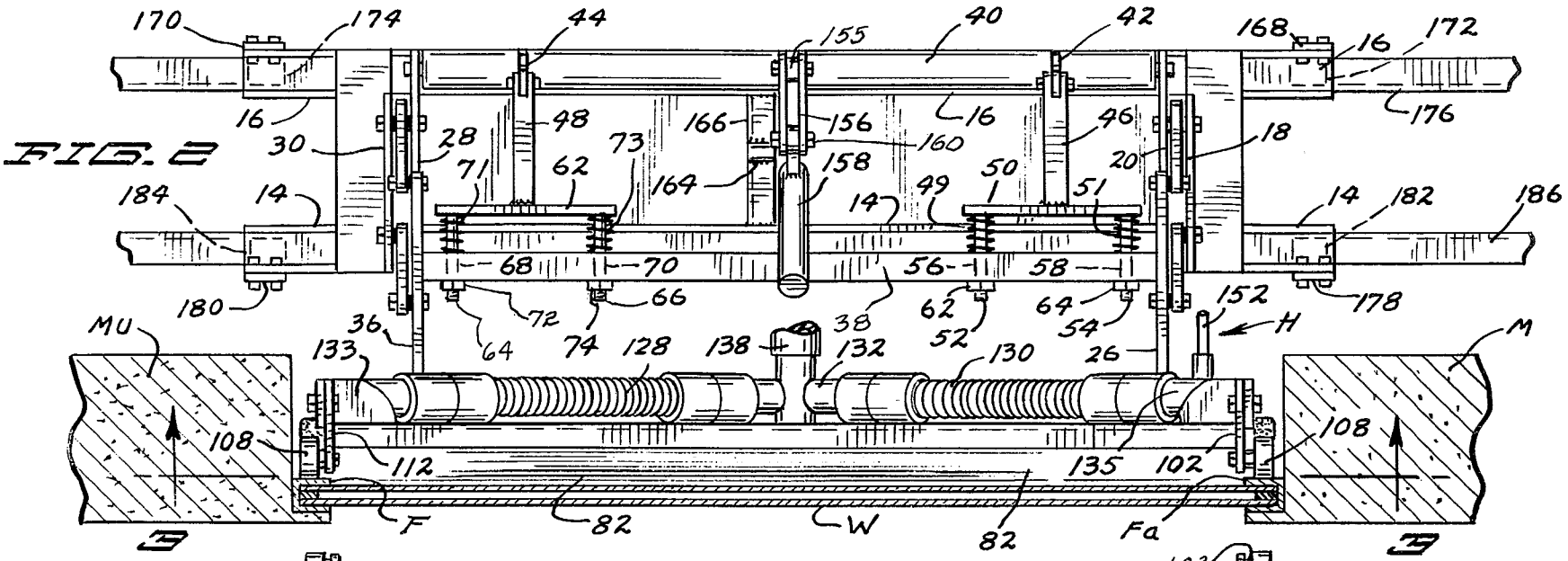
Figure 3:
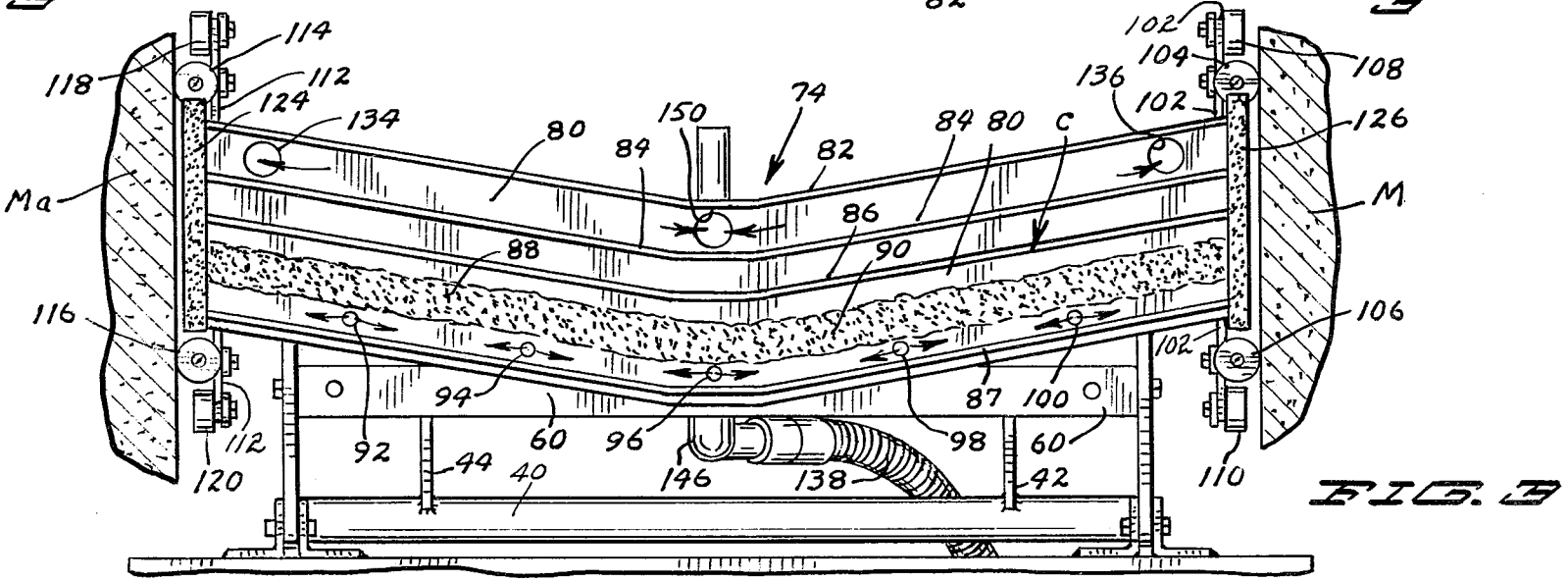
FIG. 3 is a front elevational view of the washing head on the line 3—3 of FIG. 2.

Referring to the drawings in detail, the device A includes the washing and drying head H. The head H includes the longitudinal spaced support members 14 and 16. Secured to and mounted on the support member 14 and 16 is the first pair of spaced transverse members 18 and 20, and pivotally mounted at the lower ends between the members 18 and 20 are the spaced front and rear links 22 and 24. The upper ends of the links 22 and 24 are pivotally connected to the first top bar 26. Similarly provided is the second pair of spaced transverse members 28 and 30 and pivotally mounted at the lower ends between the members 28 and 30 are the spaced front and rear links 32 and 34. The upper ends of the links 32 and 34 are pivotally connected to the second top bar 36. Connected to and extending between the links 22 and 32 is the support bar 38.

The numeral 40 designates a support rod rotatably connected at each end to and between the transverse members 20 and 28. Mounted securely at the inner ends on the rod 40 are the spaced first and second extensions 42 and 44. A link 46 is pivotally connected at its rear end to the outer free end of the first extension 42, and a link 48 is pivotally connected at its rear end to the outer free end of the second extension 44. The front end of the link 46 is secured to the rear side of the plate 50. Secured to and extending from the plate 50 are the spaced rods 52 and 54, and the rods 52 and 54 extend freely through holes 56 and 58, respectively, in the support bar 38 with the stops 62 and 64 secured to the rods 52 and 54. The ends of the support bar 38 are rotatably connected to the links 22 and 32. Springs 49 and 51 are mounted on the rods 52 and 54 between the plate 50 and bar 38.

Figure 4:
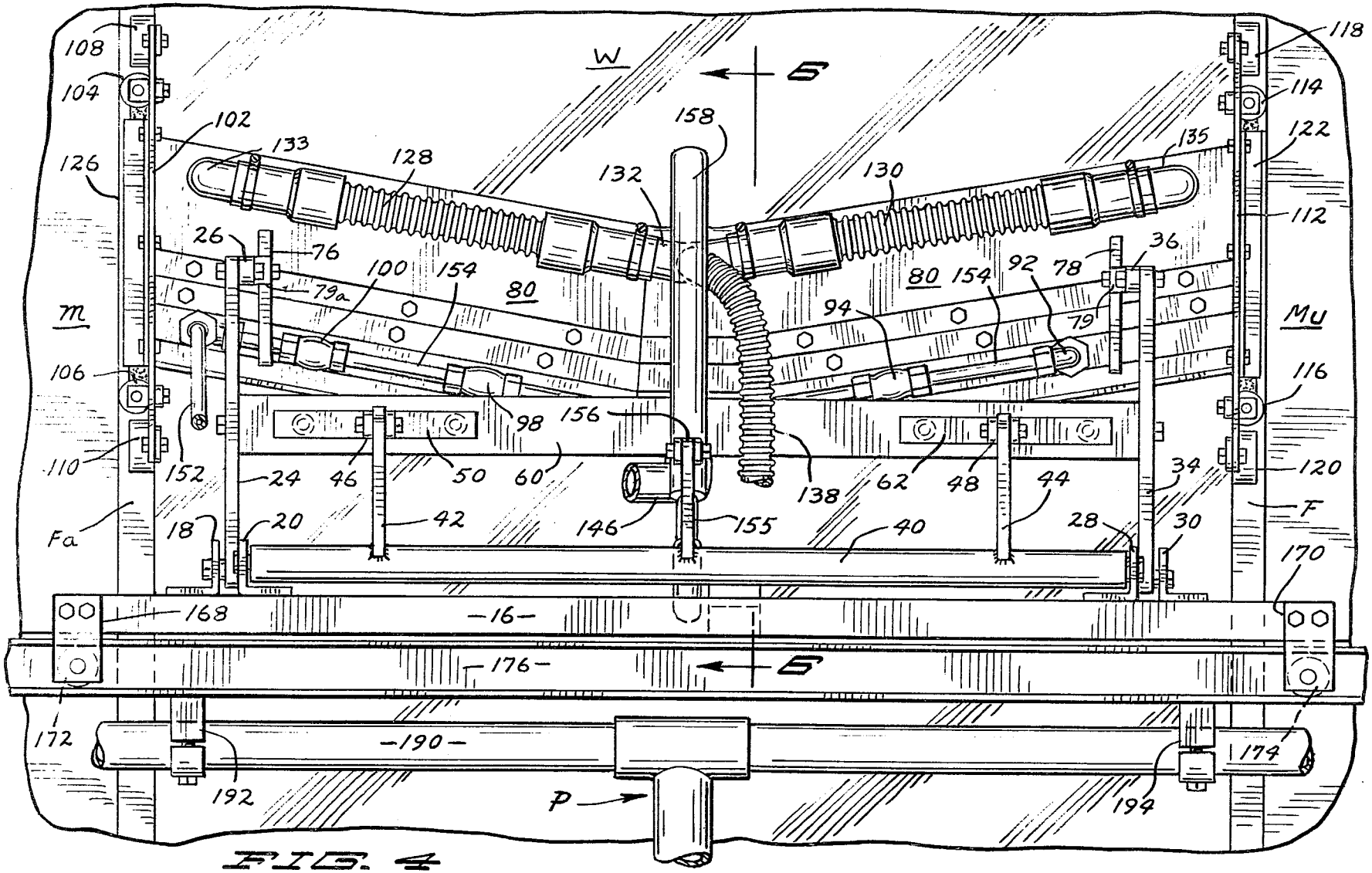
FIG. 4 is a rear view of the washing head.
Figure 7:
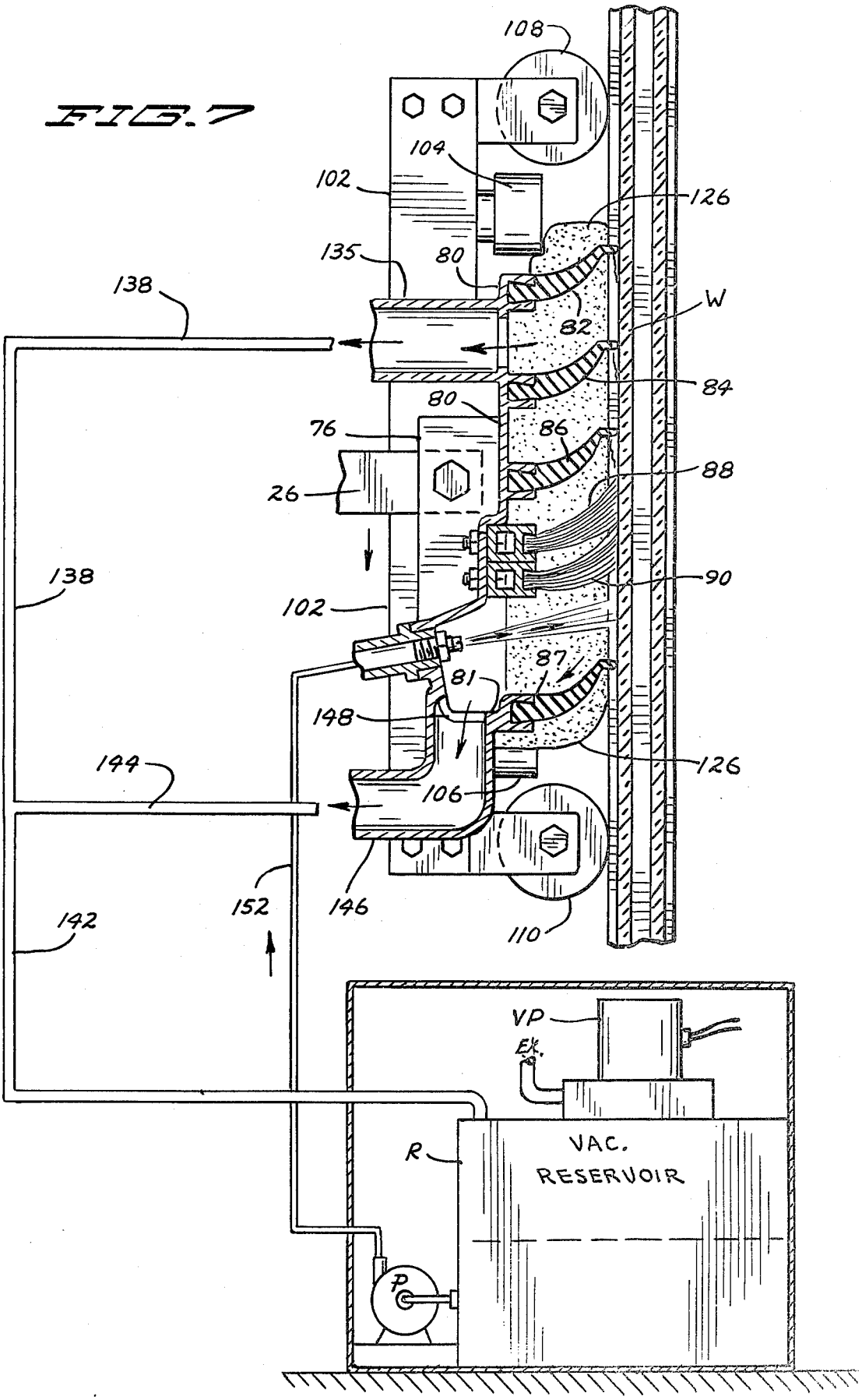
FIG. 7 is a sectional view transversely through the washing head.

The front end of the link 48 is secured to the rear side of the plate 62. Secured to and extending from the plate 62 are the spaced rods 64 and 66, and the rods 64 and 66 extend freely through holes 68 and 70, respectively, in the support bar 60 with the stops 72 and 74 secured to the rods 64 and 66. Mounted on the rods 64 and 66 between the plate 62 and the bar 60 are the springs 71 and 73. The plates 50 and 62 together with the springs and bar 38 therefor act as a shock absorbing unit and restrain the movement of the head H to thereby control the amount of deflection of the squeegee members hereinafter referred to. The inner ends of the top bars 26 and 36 are pivotally connected to connector members 76 and 78, respectively. The front edges of the connectors 76 and 78 are secured to the rear face of the squeegee and nozzle plate 80, particularly FIGS. 1, 4 and 7. Adjustably secured to the inner surface of each of said top bars 26 and 36 is a stop **79*a* and 79, respectively, which are engageable with the connector members 76 and 78 for restricting the rotation of the wash head about a rotational axis parallel to the plane of a window. The rotational head action and the forward force produced by the head reaction springs 49, 51, 71 and 73** allows the head to react to variations in window and window frame dimensions independent of the platform distance from the windows.

The plate 80 has a broad laterally extending V-formation with bottom portion 81 and has mounted thereon the spaced and parallely disposed squeegee blades 82, 84 and 86 which also have a similar V-formation. The numeral 87 designates a bottom squeegee blade also of V-formation and parallely disposed to the blades 82–86. Secured to and extending throughout the length of the plate 80 are the brushes 88 and 90 joined at the center, and positioned below the brushes and mounted on and extending through the plate 80 are the spaced cleaning fluid nozzles 92, 94, 96, 98 and 100.

Secured to one end of the plate 80 is the end bracket 102 on which is rotatably mounted the mullion reaction guide wheels 104 and 106 and the window frame guide reaction wheels 108 and 110. Secured to the other end of the plate 80 is the end bracket 112 on which is rotatably mounted the mullion guide wheels 114 and 116 and the window frame guide wheels 118 and 120. Further provided is the mount 122 secured to the bracket 112, and on the mount is mounted the cellular compressible sealing strip 124, particularly FIG. 5, which closes off one end of all the squeegee members from 82 to 87 to aid in making a vacuum chamber C between the squeegee blades. To complete the vacuum chamber there is provided the cellular compressible sealing strip 126 which is secured to mount 126 connected to bracket 102. The front surfaces of the sealing strips 124 and 126 are urged against and maintain contact with the vertical frame members F and Fa.

A vacuum supply mechanism includes the hose sections 128 and 130 connected to the pipe fitting 132 at one end with the other ends of the hose sections 128 and 130 connected to the openings 134 and 136 of plate 80, respectively, by means of elbow pipe fittings 133 and 135, between squeegee blades 82 and 84. The fitting connection 132 is connected to the hose 138 at one end with the other end of hose 138 connected to elbow fitting 140 connected at one end to vacuum supply hose 142. Vacuum supply hose 142 is connected to vacuum pump VP. The other end of fitting 140 is connected to supply hose section 144 with hose 144 connected to elbow 146 which in turn is connected to opening 148 in the bottom portion 81 of the plate 80, particularly FIG. 7. The fitting 132 is also connected to the opening 150 of the plate 80 to create a vacuum force centrally of the plate 80 between squeegee blades 82 and 84.

The numeral 152 designates a supply line for cleaning fluid which is connected to the line 154 to which the nozzles 92–100 are connected. The supply line 152 is connected to pump P which in turn is connected to reservoir R. Pump P, reservoir R, vacuum pump VP together with conventional controls therefor are contained in the cabinet Ca mounted on the conventional platform P hoisted by conventional hoisting mechanism mounted on the platform with cables connected to support booms at the top of the building and operated by conventional controls on the platform.

Figure 6:
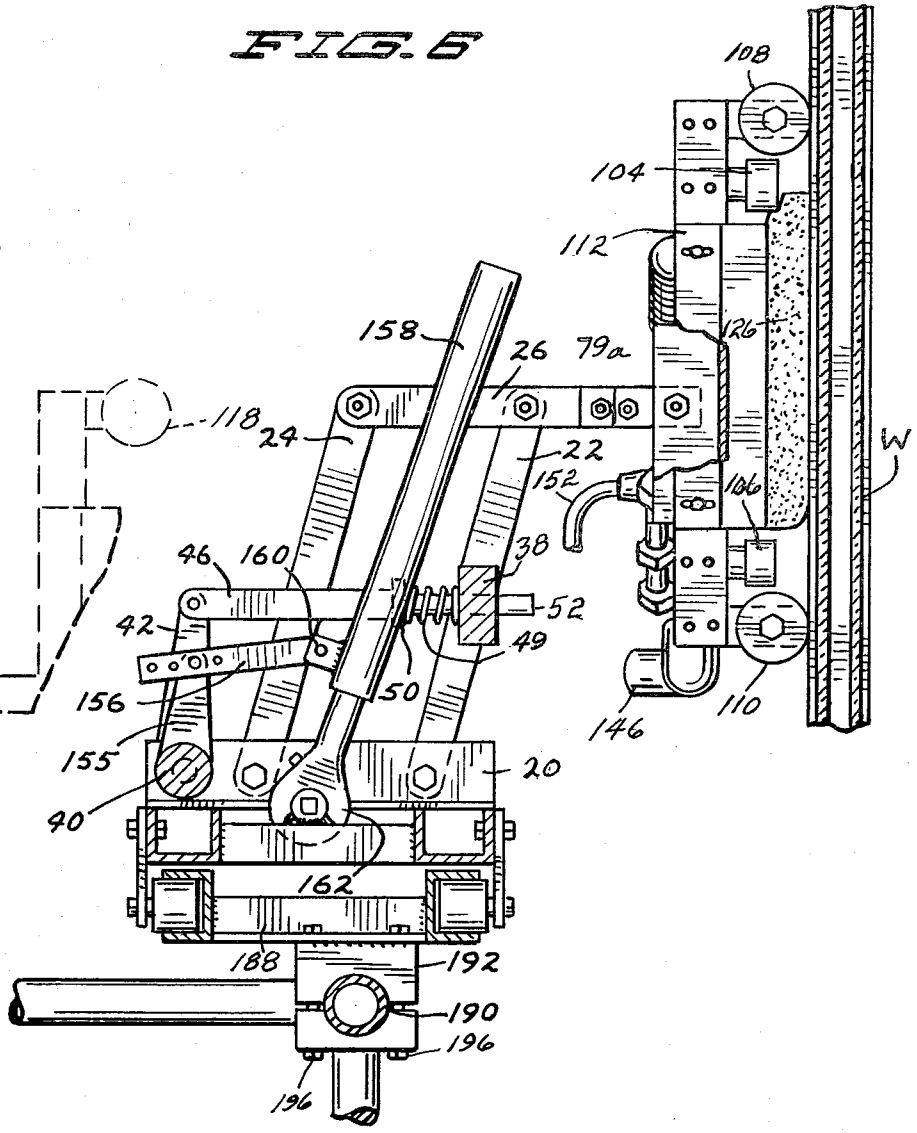
FIG. 6 is a sectional view on the line 6—6 of FIG. 4.

The rod 40 has secured centrally thereto the extension 155, and pivotally connected at one end to the free end of the extension 155 is the link 156, particularly FIGS. 1 and 6. The other end of the link 156 is pivotally connected to the control and lock handle 158 with pin 160. The lock handle 158 moves the wash head to and from a window and has formed on the lower end thereof the conventional releasable ratchet 162 mounted on the stub rod 164 secured to the cross brace 166, particularly FIG. 2, which in turn is connected to the support members 14 and 16, particularly FIGS. 1, 4 and 6. With the ratchet the linkage mechanism and head is held in a fixed adjustable position. Once the wash head H has been advanced to contact the window surface, the lock mechanism holds the head in contact with the window until the operator disengages the lock and retracts the head.

Figure 5:
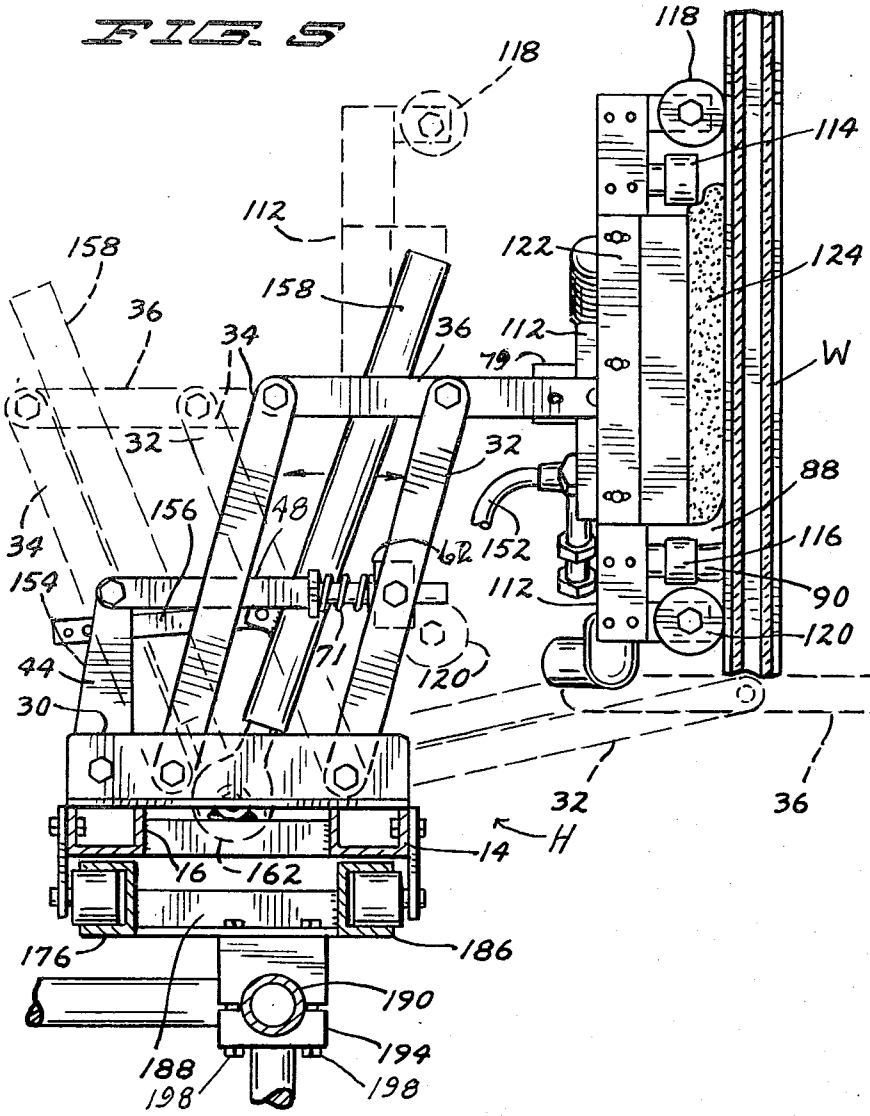
FIG. 5 is an end view of the washing head in substantially operative cleaning position with the full retracted and extended positions shown in broken lines.

It will be seen that if the control lock handle 158 is moved rearwardly in the direction of the arrow from the full line position of FIGS. 5 and 1, the washing and drying head H is moved towards the broken line position of FIG. 5 by means of the links 46 and 48 forcing the extension 155 rearwardly thereby rotating rod 40 whereby extensions 42 and 44 on rod 40 pull the head H through links 46 and 48 and bar 60 connected to links 22 and 32. The head H may be adjusted towards the remaining broken line forward position in FIG. 5 by pushing the handle 158 in the opposite direction.

With the head H in the position of FIG. 5 the rollers 108, 110, 118 and 120 are in contact with the window frames F and Fa and the rollers 104, 106, 114 and 116 are in guiding contact with the mullions M and Ma. Further the sealing strips 124 and 126 are in contact with the window frames F and Fa.

The head H is freely slidable laterally upon the selective positioning means of the head and relative to the platform and windows by means of the bars 168 and 170 secured to and depending from the longitudinal support 16, and rotatably mounted on each of the bars 168 and 170 are the rollers 172 and 174, respectively, which rotatably engage within the channel shaped track 176. Secured to and depending from the longitudinal support 14 are the bars 178 and 180 on which are rotatably mounted the rollers 182 and 184, respectively, which rotatably engage within the channel shaped track 186 similarly to rollers 172 and 174 in channel track 176. As a result the head H slidably "floats" on the tracks laterally with respect to the vertical column of windows with any inequality in the configurations of the windows or frames therefor causing the head to move horizontally on the tracks and accommodate the inequalities. In other words the head H follows contours of the building within limitations and without affecting the position of the platform. The channel tracks 176 and 186 are rigidly connected together by means of a series of spaced cross bars 188.

The platform P includes the tubular upper inner suport railing 190. Connected to the underside of the tracks 176 and 186 are the split blocks 192 and 194 which engage with and clamp onto the rail 190 by means of bolts 196 and 198, respectively, on each end of the blocks and rail. With such construction the head unit H can be adjustably positioned along the length of the platform P for cleaning operation of windows adjacent one to the other as hereinafter explained.

OPERATION

In using the device A to wash and dry vertically aligned windows on a building between mullions such as M and Mu, the device is mounted on the support railing 190 of the platform P as described hereinbefore. The platform is suspended from support booms positioned on the top of a building with cables attached to winches on the platform but not shown whereby the platform and head H thereon can be lowered and raised relative to the windows W on a building by means of an operator on the platform operating the winches. The device A cleans and dries as the platform is lowered and raised past and upon the windows.

In starting the operation, the platform P may be first placed and positioned so that the head H is opposite the uppermost of a column of windows. The handle 158 is moved to the position of FIG. 1 whereby the head H is against the window with the rollers 108, 110, 118 and 120 against the side frames of the window W and the rollers 104, 106, 114 and 116 closely adjacent the mullions M and Ma. Next the cleaning fluid is caused to flow from the nozzles and a vacuum created at the holes 134, 136 and 150 between squeegees 82 and 84. The cleaning liquid from the nozzles loosens dirt and foreign material from the window W, and as the head is lowered by means of the platform, the brushes further clean, and then the squeegees squeegee the dirty liquid from the window. The liquid travels downwardly to the bottom member 81 and is drawn out the opening 148 to the vacuum hose line 144. Dirty cleaning fluid is also drawn by means of the vacuum openings 134 and 136 through tubes 128 and 130 to tube 138 thence to tube 142 and into the reservoir R.

Further the strips 124 and 126 are in sliding contact with the window frames, and the rollers 104, 106, 114 and 116 guide the unit H between the mullions M and Mu. As the device A is operated as above, the platform P is lowered, and as it is lowered the vertical row of windows are progressively cleaned by the brushes 88 and 90, cleaning fluid from the nozzles, the vacuum pickup and the squeegee action of the squeegee blades. As the head H lowers with the platform the head can move laterally due to unevenness in the mullions due to the free slidability of the unit on the rails 176 and 186. The rollers 104, 106, 114 and 116 guide the head between the mullions. As the head unit H meets an obstruction such as a window cross bar the squeegee members absorb the same. Any abnormally large obstruction causes the head to move outwardly due to the compression takeup of the springs 49, 51, 71 and 73.

When the lowermost window of a column of windows is cleaned, the head H is made inoperative and withdrawn from the window surface by means of the mechanism hereinbefore described. The head unit H is then slidably moved on the support railing 190 of the platform in alignment with an adjoining column of windows. The operation is then repeated by raising the platform whereby windows are cleaned as the head H is raised past the windows. This is done without moving the hoist equipment and platform for the head H is moved on the platform to its new position thereon. This is continued until the head H is moved to the opposite end of the platform. To clean additional windows laterally of the building to an extent greater than the length of the platform the support booms on the top of the building are moved laterally together with the platform and the operation repeated.

Two or more heads H may be mounted on the rails 176 and 186 in side-by-side relationship whereby two or more vertical columns of windows may be simultaneously cleaned as the platform P is moved over the windows. It will be seen that the device may be easily adaptable to conventional platforms such as P and that the device may be operated together with the winch hoist mechanism on the platform by a single operator riding the platform. If need be the head H may be used to clean a window at a given level and then slidably moved on the rails to a window in a horizontally adjacent column of windows by raising the platform and lowering the platform and head thereon to clean the adjacent window. The platform P has mounted on the side adjacent the windows spaced rollers, not shown, which contact the outward facing surface of the mullions and allow rolling movement of the platform up and down upon the mullions M and Ma.

We claim:

1. An apparatus for cleaning a column of windows and/or wall surfaces of a building in combination with a platform having a support railing spanning a plurality of vertical columns of windows and movable up and down on the building comprising:

(a) support means, (b) cleaning means for the window and/or wall surfaces, (c) means movably mounting said cleaning means on said support means allowing movement of said cleaning means in substantially a horizontal plane from a non-cleaning position spaced from a window to a position upon a window for the cleaning thereof, (d) means mounting said support means translatably on said support railing for the purposes of both accommodating unevenness in the mullion surfaces of a building as the apparatus is moved upon a building vertically during cleaning, and for allowing said support means to be moved from one column of windows to another column, (e) means carried by the platform for supplying cleaning material to the cleaning means, (f) said cleaning means including a vacuum housing, and (g) means carried by the platform for supplying a vacuum to said vacuum housing for picking up dirt and cleaning material supplied by said cleaning means, and (h) means carried by said support means for guiding the cleaning means relative to the face of a building as the platform is raised and lowered upon the building for cleaning the same.

2. The device of claim 1 in which said cleaning means includes at least one brush associated with said cleaning material supplying means.

3. The device of claim 1 in which said means mounting said support means translatably on said support railing includes:

(a) rail means mounted on said platform support railing, and (b) rollers carried by said support means for rolling engagement with said rail means.

4. The device of claim 1 in which said means carried by the support means for guiding the cleaning means relative to the face of a building includes:

(a) rollers for contact with the frame surfaces of a window, and (b) rollers for contact with mullions of a building.

5. The device of claim 1 in which said means movably mounting said cleaning means on said support means to and from a cleaning position upon a window of a building includes:

(a) link means pivotally connected to said support means and said cleaning means, and (b) means carried by said support means for moving and locking said link means in selected positions to thereby selectively position said cleaning means relative to the window and/or wall surface of a building.

6. The device of claim 5 in which said link means carries lock means for limiting the extent of the movement of the link means.

7. The device of claim 1 in which said cleaning means includes:

(a) nozzle means connected to said support means, and (b) squeegee means carried by said support means unit adjacent said nozzle means.

8. The device of claim 1 in which said cleaning means includes:

(a) spaced flexible squeegee members mounted on said vacuum housing and between which said vacuum supplying means is positioned, and (b) means for restraining the movement of the cleaning means to thereby control the degree of deflection of the flexible squeegee members upon the windows.

9. The device of claim 1 in which said means movably mounting said cleaning means on said support means has resilient means connected to and interposed between said movable mounting means and said support means for absorption of movement of said cleaning means as it passes over irregularities extending from the face of a building.

10. The device of claim 1 in which said means mounting said support means translatably on said support railing includes:

(a) rail means mounted on said support railing of said platform, and (b) rollers carried by said support means for rolling engagement with said rail means, (c) said means for guiding the cleaning means relative to the face of a building including rollers in rolling contact with the frame surfaces of a window, and (d) rollers for contact with mullions of a building.

* * * * *